US011602222B1

(12) United States Patent
Maksymowicz et al.

(10) Patent No.: US 11,602,222 B1
(45) Date of Patent: Mar. 14, 2023

(54) PHYSIOTHERAPEUTIC ROCKING CHAIR DEVICE

(71) Applicants: Jerzy Maksymowicz, Jackson Heights, NY (US); Chris Maksymowicz, New York, NY (US)

(72) Inventors: Jerzy Maksymowicz, Jackson Heights, NY (US); Chris Maksymowicz, New York, NY (US)

( * ) Notice: Subject to any disclaimer, the term of this patent is extended or adjusted under 35 U.S.C. 154(b) by 0 days.

(21) Appl. No.: 17/589,937

(22) Filed: Feb. 1, 2022

Related U.S. Application Data

(60) Provisional application No. 63/244,440, filed on Sep. 15, 2021.

(51) Int. Cl.
*A47C 3/029* (2006.01)
*A47C 4/28* (2006.01)

(52) U.S. Cl.
CPC ..... *A47C 3/029* (2013.01); *A47C 4/28* (2013.01)

(58) Field of Classification Search
CPC ..... A47C 3/029; A47C 1/034; A47C 1/035; A47C 3/02; A47C 4/28
USPC ..... 297/32, 33
See application file for complete search history.

(56) References Cited

U.S. PATENT DOCUMENTS

| | | | | | |
|---|---|---|---|---|---|
| 172,665 | A * | 1/1876 | Sleight | 297/19 | |
| 676,788 | A * | 6/1901 | Wallis | 297/20 | |
| 3,414,321 | A * | 12/1968 | Beck | A47C 4/40 | 297/29 |
| 4,772,067 | A * | 9/1988 | Fowler | A47C 3/02 | 297/130 |
| 6,257,660 | B1 * | 7/2001 | Calvey | A47C 3/029 | 297/16.2 |
| 7,156,456 | B1 * | 1/2007 | Chen | A47C 4/20 | 297/271.4 |
| 7,407,229 | B1 * | 8/2008 | Chen | A47C 1/034 | 297/DIG. 7 |
| 2003/0214159 | A1 * | 11/2003 | Brandschain | A47C 4/22 | 297/32 |

* cited by examiner

*Primary Examiner* — Sarah B McPartlin
(74) *Attorney, Agent, or Firm* — Brennan, Manna & Diamond, LLC

(57) ABSTRACT

The present invention relates to a physiotherapeutic rocking chair device that is primarily comprised of a seating area, a main frame assembly on each side of the seating area, and a seating area frame assembly. The main frame assembly is comprised of at least one skid plate member that has a convex bottom edge that allows the device to easily rock back and forth. The seating area frame assembly is further comprised of a footrest that a user can press against to rock the device back and forth. In this manner, the device can be used to strength and/or rehabilitate the lower body/legs of a user. The seating area and seating area frame assembly and further be positioned such that they are parallel to a ground surface in order to allow a non-ambulant user to be easily transferred on to the device.

17 Claims, 4 Drawing Sheets

PHYSIOTHERAPEUTIC ROCKING CHAIR DEVICE

CROSS-REFERENCE TO RELATED APPLICATION

The present application claims priority to, and the benefit of, U.S. Provisional Application No. 63/244,440, which was filed on Sep. 15, 2021, and is incorporated herein by reference in its entirety.

FIELD OF THE INVENTION

The present invention relates generally to the field of rocking chairs. More specifically, the present invention relates to a physiotherapeutic rocking chair device that is primarily comprised of a seating area, a main frame assembly on each side of the seating area, and a seating area frame assembly. The main frame assembly and the seating area frame assembly are identical in structure on both sides of the seating area of the device. The main frame assembly is comprised of at least one skid plate member that has a convex bottom edge that allows the device to easily rock back and forth. The seating area frame assembly is further comprised of a footrest that a user can press against to rock the device back and forth. In this manner, the device can be used to strength and/or rehabilitate the lower body/legs of a user. The seating area and seating area frame assembly and further be positioned such that they are parallel to a ground surface in order to allow a non-ambulant user to be easily transferred on to the device. Accordingly, the present disclosure makes specific reference thereto. Nonetheless, it is to be appreciated that aspects of the present invention are also equally applicable to other like applications, devices and methods of manufacture.

BACKGROUND

Many individuals enjoy sitting on rocking chairs. Typically, in order rock a rocking chair a user must move their back against the back of the seat of the rocking chair. Further, many individuals may suffer from chronic conditions, illnesses, or injuries that lead to decreased leg and lower body strength and as a result, the inability to walk. Said individuals are typically wheelchair bound indefinitely, or at least while rehabbing their lower body injury. However, sitting in a wheelchair or other chair does not provide said individual with the ability to rehabilitate and gain strength in their lower body/legs. Further, it may also be difficult for non-ambulatory individuals to get into a rocking chair themselves, or even with the assistance of a secondary individual.

Therefore, there exists a long-felt need in the art for a rocking chair device that offers an alternative method of allowing a user to rock the chair. Further, there exists a long-felt in the art for a physiotherapeutic rocking chair device that allows a user to rehab a lower body and/or leg injury. In addition, there exists a long-felt in the art for a physiotherapeutic rocking chair device that allows a user to rehab a lower body and/or leg injury while using the device itself. Finally, there exists a long-felt in the art for a physiotherapeutic rocking chair device that allows a non-ambulant user to easily sit in the device.

The subject matter disclosed and claimed herein, in one embodiment thereof, comprises a physiotherapeutic rocking chair device. The device is primarily comprised of a seating area, a main frame assembly on each side of the seating area, and a seating area frame assembly. The main frame assembly and the seating area frame assembly are identical in structure on both sides of the seating area of the device. The main frame assembly is comprised of at least one skid plate member that has a convex bottom edge that allows the device to easily rock back and forth. The seating area frame assembly is further comprised of a footrest that a user can press against to rock the device back and forth. In this manner, the device can be used to strength and/or rehabilitate the lower body/legs of a user. The seating area and seating area frame assembly and further be positioned such that they are parallel to a ground surface in order to allow a non-ambulant user to be easily transferred on to the device.

In this manner, the physiotherapeutic rocking chair device of the present invention accomplishes all of the forgoing objectives and provides a rocking chair device that offers an alternative method of allowing a user to rock the chair. Further, the physiotherapeutic rocking chair device allows a user to rehab a lower body and/or leg injury while using the device itself. Finally, the physiotherapeutic rocking chair device that allows a non-ambulant user to easily sit in the device.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a physiotherapeutic rocking chair device. The device is primarily comprised of a seating area, a main frame assembly on each side of the seating area, and a seating area frame assembly. In the preferred embodiment of the device, the main frame assembly and seating area frame assembly are manufactured from a durable material such as, but not limited to: wood, metal, or rigid plastic. The seating area has a backrest and a seat that may also be comprised of said durable material. In an alternative embodiment, the backrest and seat may be comprised of a durable fabric material.

The main frame assembly and the seating area frame assembly are identical in structure on both sides of the seating area of the device. The main frame assembly is comprised of at least one skid plate member that has a convex bottom edge that allows the device to easily rock back and forth. Each end of the skid plate member is also rounded such that is does not damage (i.e., scratch, dent, damage, etc.) any floor surface the device is placed on.

Each main frame assembly on both sides of the seating area is connected to one another by at least one horizontal cross member and at least one convex bottom frame member. Each main frame assembly is further comprised of at least two, but preferably three angled frame members that may attach to the skid plate member and to each angled members to provide additional structural support to said members. At least one arm rest member is fixedly attached to at least one horizontal arm rest support member, wherein the harm rest support member further connects to the at least two angled members and is preferably parallel and located above the skid plate member.

The seating area frame assembly is positioned between and attaches to each main frame assembly and is further comprised of at least four angled frame members, at least two horizontal frame members, and at least one footrest. Two of the at least four angled frame members provide support to the backrest of the seating area and attach to the horizontal arm rest support member. The remaining two angled frame members also attach to the horizontal arm rest support member but then attach to the at least two horizontal frame members and to the horizontal arm rest support member. The at least two horizontal frame members further attach to the two angled frame members that provide support to the backrest of the seating area. The horizontal frame members are further connected to at least one footrest that is preferably angled such that a user can place their feet on the footrest. To use the device, a user can press their feet against the footrest to cause the device to rock back and forth on the skid plate members. In this manner, the device allows a user to strengthen their lower body and/or leg muscles by requiring the pressing of a user's feet against the footrest to rock the device.

All components of the main frame assembly, seating area frame assembly, and seating area are preferably connected to one another via an at least one fastener such as, but not limited to: a hinge, a pivot pin, a screw, a bolt, a nail, etc. that allows the main frame assembly, seating area frame assembly, and seating area to be repositioned. As a result, the device 100 can fold for storage and transport purposes. The seating area frame assembly can also be repositioned such that the seating area becomes flat and is therefore parallel with a floor surface. In this manner, a non-ambulant user can be easily transferred from a lying position on a flat bed, stretcher, or other surface (with the assistance of other individuals) to a lying position on the seating area. Then, the seating area frame assembly can be repositioned by physically adjusting the frame members of the frame assembly to transform the seating area frame assembly and seating area into a normal position for sitting.

Accordingly, the physiotherapeutic rocking chair device of the present invention is particularly advantageous as it provides a rocking chair device that offers an alternative method of allowing a user to rock the chair. Further, the physiotherapeutic rocking chair device allows a user to rehab a lower body and/or leg injury while using the device itself. Finally, the physiotherapeutic rocking chair device that allows a non-ambulant user to easily sit in the device. In this manner, the physiotherapeutic rocking chair device overcomes the limitations of existing rocking chairs known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
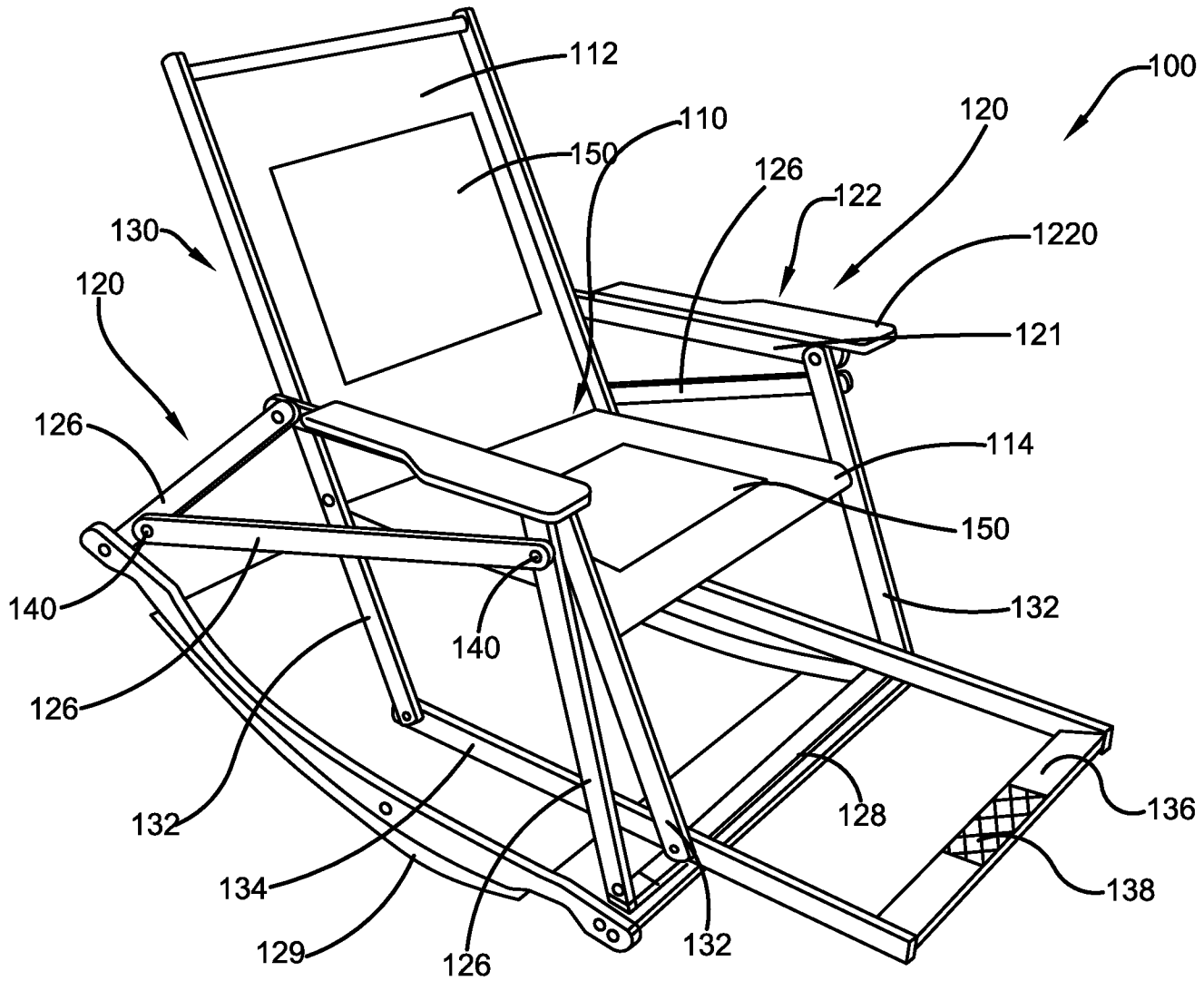
FIG. 1 illustrates a perspective view of one potential embodiment of a physiotherapeutic rocking chair device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a rocking chair device that offers an alternative method of allowing a user to rock the chair. Further, there exists a long-felt in the art for a physiotherapeutic rocking chair device that allows a user to rehab a lower body and/or leg injury. In addition, there exists a long-felt in the art for a physiotherapeutic rocking chair device that allows a user to rehab a lower body and/or leg injury while using the device itself. Finally, there exists a long-felt in the art for a physiotherapeutic rocking chair device that allows a non-ambulant user to easily sit in the device.

The present invention, in one exemplary embodiment, is comprised of a physiotherapeutic rocking chair device. The device is primarily comprised of a seating area, a main frame assembly on each side of the seating area, and a seating area frame assembly. The main frame assembly and the seating area frame assembly are identical in structure on both sides of the seating area of the device, and wherein the main frame assembly is comprised of at least one skid plate member that has a convex bottom edge that allows the device to easily rock back and forth. The seating area frame assembly is further comprised of a footrest that a user can press against to rock the device back and forth such that device can be used to strength and/or rehabilitate the lower body/legs of a user. The seating area and seating area frame assembly and further be positioned such that they are parallel to a ground surface in order to allow a non-ambulant user to be easily transferred on to the device.

Referring initially to the drawings, FIG. 1 illustrates a perspective view of one potential embodiment of a physiotherapeutic rocking chair device 100 of the present invention in accordance with the disclosed architecture. The device 100 is primarily comprised of a seating area 110, a main frame assembly 120 on each side of the seating area 110, and a seating area frame assembly 130. In the preferred embodiment of the device 100, the main frame assembly 120 and seating area frame assembly 130 are manufactured from a durable material such as, but not limited to: wood, metal, or rigid plastic. The seating area 110, which is comprised of a backrest 112 and a seat 114, may also be comprised of said durable material wherein the backrest 112 and seat 114 are also comprised of a padding 150. In an alternative embodiment, the backrest 112 and seat 114 may be comprised of a durable fabric material that is attached to both frame assemblies 120,130 in a taunt manner.

Figure 2:
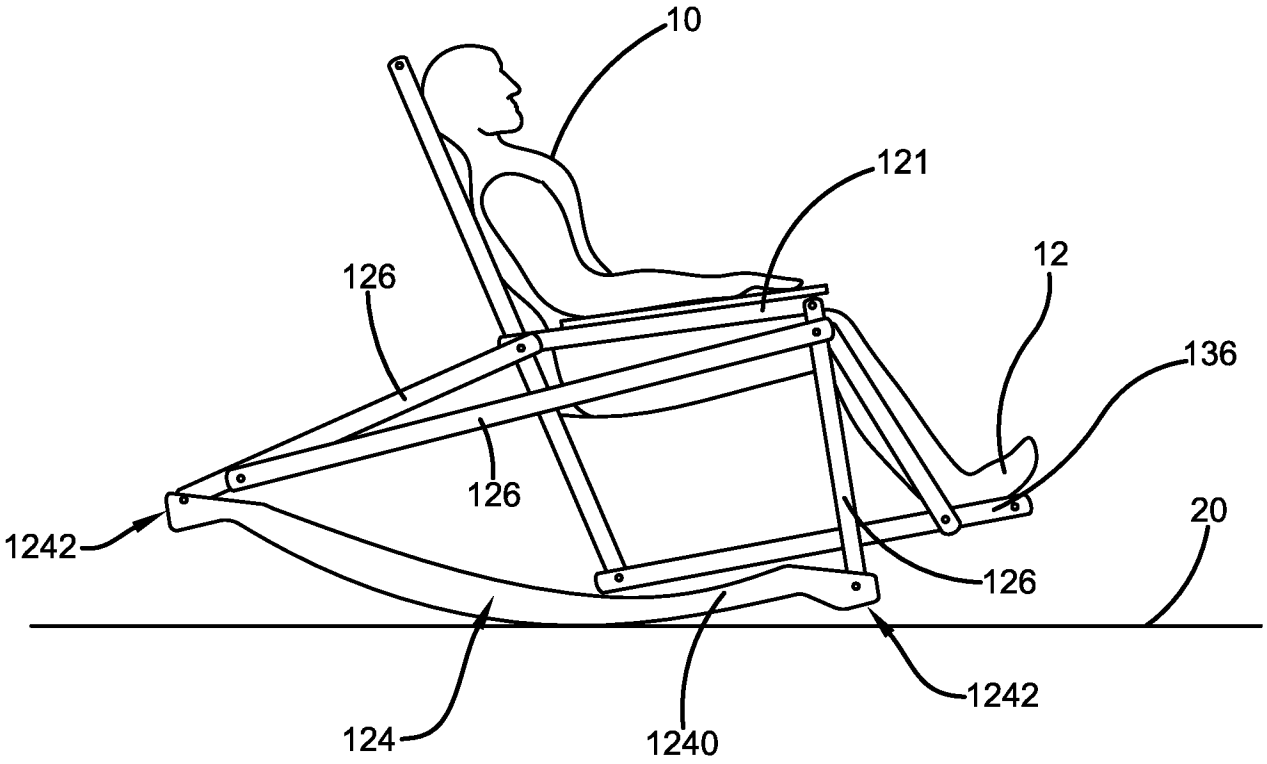
FIG. 2 illustrates a side view of one potential embodiment of a physiotherapeutic rocking chair device of the present invention while a user is sitting in the device in accordance with the disclosed architecture.

It should be appreciated that the main frame assembly 120 and the seating area frame assembly 130 are identical in structure on both sides of the seating area 110 of the device 100, as best seen in FIG. 1. The main frame assembly 120 provides structural support to the device 100. On each side of the seating area 110, the main frame assembly 120 is comprised of at least one skid plate member 124. The skid plate member 124 preferably has a convex bottom edge 1240 that allows the device 100 to easily rock back and forth. Each end 1242 of the skid plate member 124 is also rounded such that is does not damage (i.e., scratch, dent, damage, etc.) any floor surface 20 the device 100 is placed on, as best seen in FIG. 2. It should be appreciated the device 100 can be used on any surface 20 including indoor surfaces 20 such as, but not limited to: carpet, hardwood, tile, etc. and outdoor surfaces 20 such as, but not limited to: grass, dirt, snow, sand, etc.

Each main frame assembly 120 on both sides of the seating area 110 is connected to one another by at least one horizontal cross member 128 and at least one convex bottom frame member 129. Each frame assembly 120 is further comprised of at least two, but preferably three angled frame members 126. In any embodiment, at least two angled frame members 126 attach to the skid plate member 124. In an embodiment with three angled members 126, the third angled member may connect to the at least two angled members 126 to provide additional structural support to said members 126. At least one arm rest member 122 is fixedly attached to at least one horizontal arm rest support member 121, wherein the harm rest support member 121 further connects to the at least two angled members 126 and is preferably parallel and located above the skid plate member 124. In one embodiment, the arm rest 122 may further have a padded top surface 1220.

The seating area frame assembly 130 is positioned between and attaches to each main frame assembly 120. The frame assembly 130 is further comprised of at least four angled frame members 132, at least two horizontal frame members 136, and at least one footrest 136. Two of the at least four angled frame members 132 provide support to the backrest 112 of the seating area 110 and attach to the horizontal arm rest support member 121. The remaining two angled frame members 132 also attach to the horizontal arm rest support member 121 but then attach to the at least two horizontal frame members 134 and to the horizontal arm rest support member 121. The at least two horizontal frame members 134 further attach to the two angled frame members 132 that provide support to the backrest 112 of the seating area 110. The horizontal frame members 134 are further connected to at least one footrest 136. The footrest 136 is preferably angled such that a user can place their feet 12 on the footrest 136. The footrest 136 may also be comprised of a textured area 138 that promotes grip between the feet 12 of the user 10 and the footrest 136. To use the device 100, a user 10 can press their feet 12 against the footrest 136 to cause the device 100 to rock back and forth on the skid plate members 124. In this manner, the device 100 allows a user 10 to strengthen their lower body and/or leg muscles by requiring the pressing of a user's 10 feet against the footrest 136 to rock the device 100.

Figure 3:
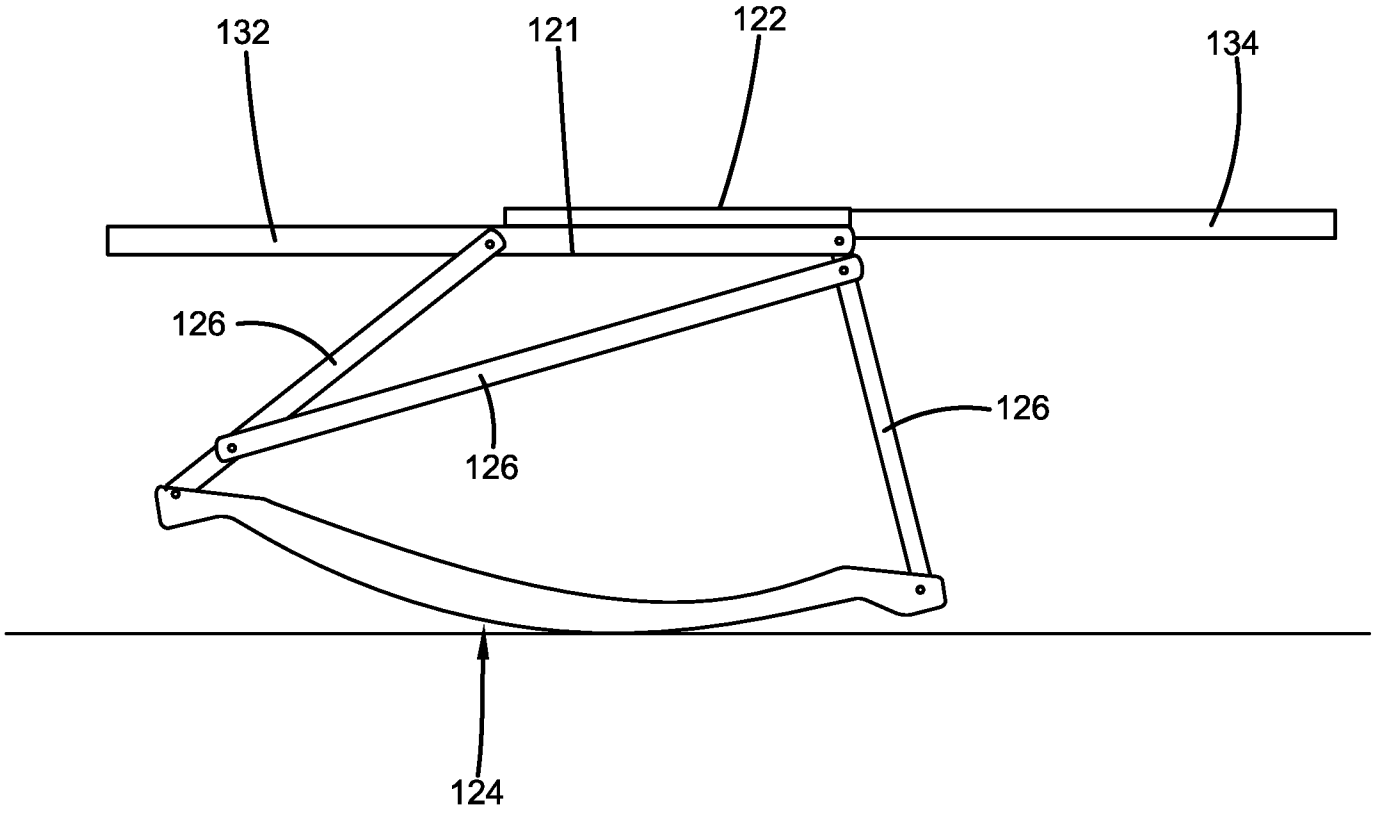
FIG. 3 illustrates a side view of one potential embodiment of a physiotherapeutic rocking chair device of the present invention in accordance with the disclosed architecture.

FIG. 3 illustrates a side view of one potential embodiment of a physiotherapeutic rocking chair device 100 of the present invention in accordance with the disclosed architecture. It should be noted that all components of the seating area 110, main frame assembly 120, and seating area frame assembly 130 may be connected to another other via at least one fastener 140. In differing embodiments, the at least one fastener 140 may be any hinge-type known in the art such as, but not limited to: an offset blind hinge, a knuckle hinge, a butt hinge, a rising butt hinge, a gravity pivot hinge, a ball bearing hinge, a barrel hinge, a concealed hinge, a knife hinge, a piano hinge, a strap hinge, a pivot hinge, a gas-piston hinge, an injection molded hinge, a locking hinge, etc. In another embodiment, the fastener 140 may be fasteners such as, but not limited to: a pivot pin, a screw, a bolt, a nail, etc.

As a result, the at least one fastener 140 allows the seating area frame assembly 130 to be repositioned such that the seating area 110 becomes flat and is therefore parallel with a floor surface 20. In this manner, a non-ambulant user 10 can be easily transferred from a lying position on a flat bed, stretcher, or other surface (with the assistance of other individuals) to a lying position on the seating area 110. Then, the seating area frame assembly 130 can be repositioned by physically adjusting the frame members 132,134 of the frame assembly 130 to transform the seating area frame assembly 130 and seating area 110 into a normal position for sitting (as shown in FIG. 1 and FIG. 2). It should also be appreciated that the angle of the backrest 112 can also be adjusted to a more reclined or upright position by physically repositioning the angled frame members 132.

Figure 4:
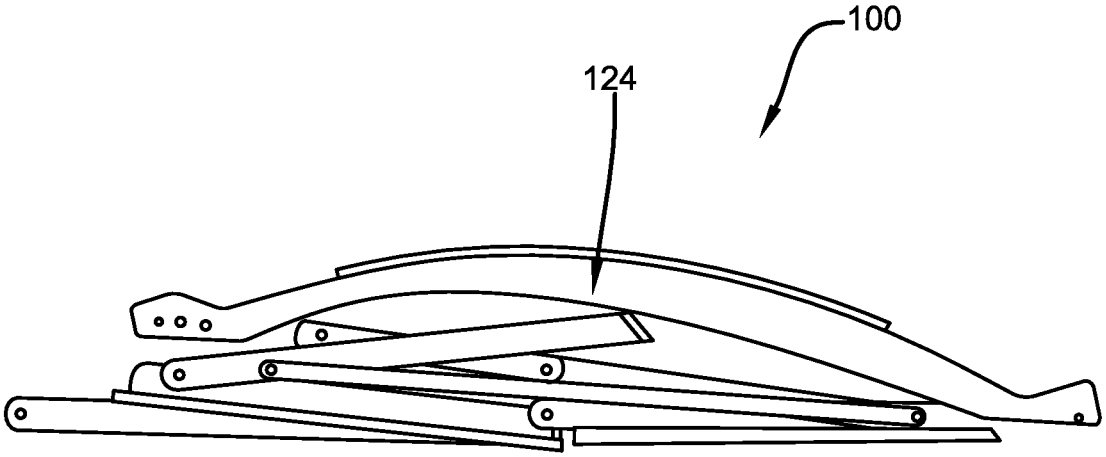
FIG. 4 illustrates a side view of one potential embodiment of a physiotherapeutic rocking chair device of the present invention while folded in accordance with the disclosed architecture.

FIG. 4 illustrates a side view of one potential embodiment of a physiotherapeutic rocking chair device 100 of the present invention while folded in accordance with the disclosed architecture. The at least one fastener 140 further allows the seating area 110, main frame assembly 120, and seating area frame assembly 130 to be completely folded. In this manner, the device 100 collapses into a much smaller overall footprint. As a result, the device 100 can be easily stored and transported.

It should further be appreciated that the device 100 can be used for a plurality of purposes. In one instance, the device 100 can be used as a physiotherapy tool to rehabilitate the strength of the lower body and/or legs of a user 10. In another instance, the device 100 can be used for recreational purposes as would a normal rocking chair (i.e., wherein the device 100 is not being used for physiotherapy purposes).

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "physiotherapeutic rocking chair device" and "device" are interchangeable and refer to the physiotherapeutic rocking chair device 100 of the present invention.

Notwithstanding the forgoing, the physiotherapeutic rocking chair device 100 of the present invention and its various components can be of any suitable size and configuration as is known in the art without affecting the overall concept of the invention, provided that they accomplish the above-stated objectives. One of ordinary skill in the art will appreciate that the size, configuration and material of the physiotherapeutic rocking chair device 100 as shown in the FIGS. are for illustrative purposes only, and that many other sizes and shapes of the physiotherapeutic rocking chair device 100 are well within the scope of the present disclosure. Although the dimensions of the physiotherapeutic rocking chair device 100 are important design parameters for user convenience, the physiotherapeutic rocking chair device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A physiotherapeutic rocking chair device comprising:
a seating area comprised of a backrest and a seat;
a horizontal cross member;
a bottom frame member;
a pair of main frame assemblies each comprised of a horizontal arm rest support member, an arm rest, a skid plate member, and a pair of angled members;
a seating area frame assembly positioned between the pair of main frame assemblies and comprised of a set of four angled frame members, at least one footrest, and a pair of horizontal frame members, wherein the pair of horizontal frame members is attached to the at least one footrest;
at least one fastener;
wherein the seating area frame assembly is repositionable so that the seating area becomes flat and substantially parallel with a floor surface; and
further wherein the backrest, the seat, the four angled frame members, the pair of horizontal frame members, the at least one footrest, and the horizontal arm rest support member are coplanar and substantially parallel to the floor surface when the seating area is substantially parallel with the floor surface.

2. The physiotherapeutic rocking chair device of claim 1, wherein the physiotherapeutic rocking chair device is repositionable between a folded orientation and an open orientation.

3. The physiotherapeutic rocking chair device of claim 1, wherein pressing against the at least one footrest causes the physiotherapeutic rocking chair device to engage in a rocking motion.

4. The physiotherapeutic rocking chair device of claim 1, wherein an angle of the backrest relative to the seat can be adjusted.

5. The physiotherapeutic rocking chair device of claim 1, wherein the at least one fastener is a hinge, a pivot pin, a screw, a bolt or a nail.

6. The physiotherapeutic rocking chair device of claim 1, wherein the backrest and the seat are manufactured from a fabric material.

7. A physiotherapeutic rocking chair device comprising:
a seating area further comprised of a backrest and a seat;
a horizontal cross member;
a bottom frame member;
a pair of main frame assemblies each comprising a horizontal arm rest support member, an arm rest, a skid plate member further comprised of a pair of rounded ends, and a pair of angled members that attach to the skid plate member and to the horizontal arm rest support member;
a seating area frame assembly positioned between the pair of main frame assembles and comprised of a set of four angled frame members, a footrest, and a pair of horizontal frame members that attach to the footrest;
at least one fastener that connects the seating area, the pair of main frame assemblies and the seating area frame assembly;
wherein the seating area frame assembly is repositionable so that the seating area becomes flat and substantially parallel with a floor surface; and
further wherein the backrest, the seat, the set of four angled frame members, the footrest, the pair of horizontal frame members, and the horizontal arm rest support member are coplanar and substantially parallel to the floor surface when the seating area is substantially parallel with the floor surface.

8. The physiotherapeutic rocking chair device of claim 7, wherein the physiotherapeutic rocking chair device is repositionable between a folded orientation and an open orientation.

9. The physiotherapeutic rocking chair device of claim 7, wherein pressing against the footrest causes the physiotherapeutic rocking chair device to engage in a rocking motion.

10. The physiotherapeutic rocking chair device of claim 7, wherein the angle of the backrest relative to the seat can be adjusted.

11. The physiotherapeutic rocking chair device of claim 7, wherein the at least one fastener is a hinge, a pivot pin, a screw, a bolt, or a nail.

12. The physiotherapeutic rocking chair device of claim 7, wherein the backrest and the seat are manufactured from a fabric material.

13. A physiotherapeutic rocking chair device comprising:
a seating area further comprised of a padded backrest and a padded seat;
a horizontal cross member;
a bottom frame member;
a pair of main frame assemblies interconnected by the horizontal cross member and the bottom frame member, wherein each of the pair of main frame assemblies is comprised of a horizontal arm rest support member, an arm rest with a padded top surface, a skid plate member further comprised of a pair of rounded ends, and a pair of angled members that attach to the skid plate member and the horizontal arm rest support member;
a seating area frame assembly positioned between the pair of main frame assembles and further comprised of a plurality of angled frame members, a footrest, and a pair of horizontal frame members that attach to the footrest;

at least one fastener;

wherein the seating area frame assembly is repositionable so that the seating area becomes taut and substantially parallel with a floor surface; and further wherein the padded backrest, the padded seat, the footrest, the pair of horizontal frame members are coplanar and substantially parallel to the floor surface when the seating area is substantially parallel with the floor surface.

14. The physiotherapeutic rocking chair device of claim 13, wherein the physiotherapeutic rocking chair device is repositionable between a folded orientation and an open orientation.

15. The physiotherapeutic rocking chair device of claim 13, wherein pressing against the footrest causes the physiotherapeutic rocking chair device to engage in a rocking motion.

16. The physiotherapeutic rocking chair device of claim 13, wherein the angle of the backrest relative to the seat can be adjusted.

17. The physiotherapeutic rocking chair device of claim 13, wherein the at least one fastener is a hinge, a pivot pin, a screw, a bolt, or a nail, and further wherein the backrest and the seat are manufactured from a fabric material.

* * * * *